US006561328B1

(12) United States Patent
Huang

(10) Patent No.: US 6,561,328 B1
(45) Date of Patent: May 13, 2003

(54) MULTIFUNCTIONAL CONTAINER

(76) Inventor: Ming-Ter Huang, 8-1, Lane 308, Sec. 2, Sah Tien Rd., Taichung Hsien (TW)

( * ) Notice: Subject to any disclaimer, the term of this patent is extended or adjusted under 35 U.S.C. 154(b) by 0 days.

(21) Appl. No.: 10/105,464

(22) Filed: Mar. 26, 2002

(51) Int. Cl.[7] ..... A45C 5/12; A45C 5/13; A45C 13/26; A45C 13/34

(52) U.S. Cl. ..... 190/18 A; 190/39; 190/100; 190/103; 190/115; 190/122; 190/127; 206/320; 16/445

(58) Field of Search ..... 190/18 A, 39, 190/100, 106, 115, 122, 123, 127; 206/320; 16/445

(56) References Cited

U.S. PATENT DOCUMENTS

| | | | | | |
|---|---|---|---|---|---|
| 3,352,389 | A | * | 11/1967 | Chubb | 190/123 |
| 4,773,123 | A | * | 9/1988 | Yu | 190/18 A X |
| 4,790,431 | A | * | 12/1988 | Reel et al. | 190/109 X |
| 4,823,924 | A | * | 4/1989 | Goodin | 190/123 X |
| 5,167,306 | A | * | 12/1992 | Carrigan, Jr. | 190/115 X |
| 5,168,968 | A | * | 12/1992 | Fritze | 190/123 X |
| 5,335,759 | A | * | 8/1994 | Yeh | 190/39 X |
| 5,622,262 | A | * | 4/1997 | Sadow | 206/522 |
| 5,758,752 | A | * | 6/1998 | King et al. | 190/39 X |
| 5,826,770 | A | * | 10/1998 | Chuang | 190/100 X |
| 5,873,145 | A | * | 2/1999 | Chou | 190/18 A X |
| 6,318,552 | B1 | * | 11/2001 | Godshaw | 190/127 X |
| 6,397,047 | B1 | * | 5/2002 | Villamar et al. | 455/90 |

FOREIGN PATENT DOCUMENTS

| | | | | |
|---|---|---|---|---|
| DE | 845838 | * | 8/1952 | 190/115 |
| DE | 2214251 | * | 10/1973 | 190/122 |
| FR | 2497081 | * | 7/1982 | 190/100 |
| GB | 2124589 | * | 2/1984 | 190/18 A |
| GB | 2194137 | * | 3/1988 | 190/115 |

* cited by examiner

*Primary Examiner*—Sue A. Weaver
(74) *Attorney, Agent, or Firm*—Harrison & Egbert

(57) ABSTRACT

A multifunctional container includes a shell formed of a body piece and a cover piece pivoted to the body piece by a pivoting device, a handle member mounted on the top side of the shell, one or more wheel members mounted on the bottom side of the shell, a downsized pull rod fastened to the shell, and a shock-absorbing pad removably disposed in the interior of the body piece of the shell to locate and protect an electronic device and the like.

13 Claims, 21 Drawing Sheets

MULTIFUNCTIONAL CONTAINER

RELATED U.S. APPLICATIONS

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a container, and more particularly to a multifunctional container.

BACKGROUND OF THE INVENTION

There are a variety of conventional containers, such as handbag, briefcase, suitcase, shoulder bag, wheeled luggage, etc., which have a number of shortcomings described hereinafter.

The precision electronic devices, such as notebook computer, electronic gauges, medical instruments, and the like, can not be conveniently put into or taken out of the conventional containers referred to above. As far as the notebook computer is concerned, it must be removed from the container to operate.

The conventional containers are not provided with means to prevent the precision electronic devices from swaying or from being impacted by the external force.

Conventional wheeled luggage is not provided in the interior with means to locate securely the precision electronic devices. The conventional wheeled luggage may be provided with a compartmented interior to facilitate the holding of various electronic devices. However, the compartmented interior is not properly dimensioned to locate securely the precision electronic devices. In addition, certain conventional suitcases are moved on the surface by means of a carrier frame which is formed of a plurality of inner tubes and outer tubes, thereby resulting in a substantial increase in the tube diameter and the tube weight at the expense of the luggage capacity. Furthermore, the compartmented interior of the conventional suitcases are often designed to hold certain specific apparatus, thereby leaving a limited room to accommodate articles of other natures.

The conventional luggage is generally provided in the inner surface with a lining material which is attached to the inner surface by means of adhesive. The process of attaching the lining material to the inner surface of the luggage is time-consuming and is not cost-effective.

BRIEF SUMMARY OF THE INVENTION

The primary objective of the present invention is to provide a multifunctional container comprising a shell, one or more linings and shock-absorbing pad, one set of pivoting device, a handle member, a downsized pull rod, and one set of wheel member. The container is provided in the interior with a shock-absorbing means to protect the articles contained in the interior. The handle can be turned and located. The articles contained in the interior of the container are so located that they are ready for use without removing them from the container.

DETAILED DESCRIPTION OF THE INVENTION

Figure 1:
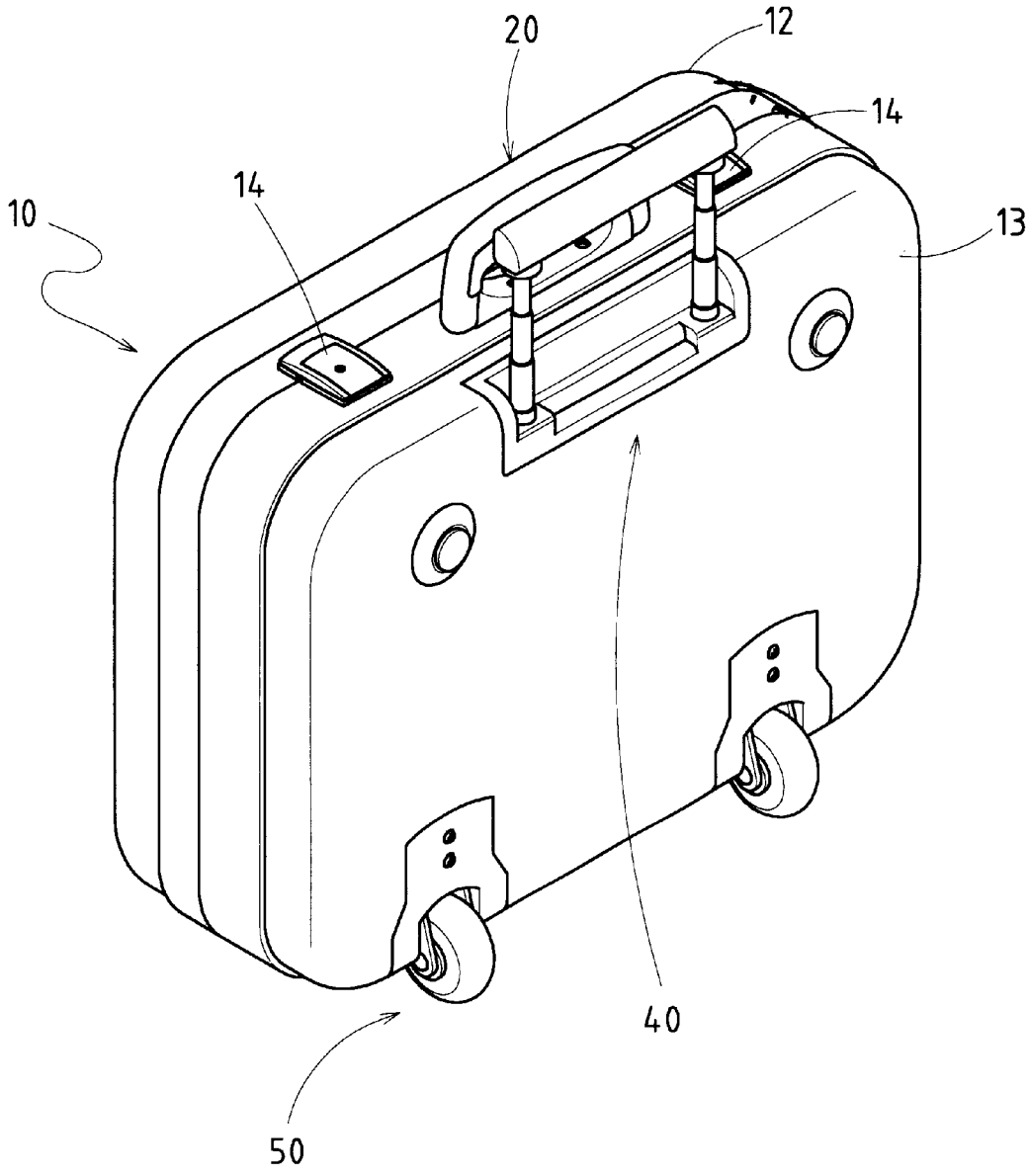
FIG. 1 shows a perspective view of the present invention.
Figure 2:
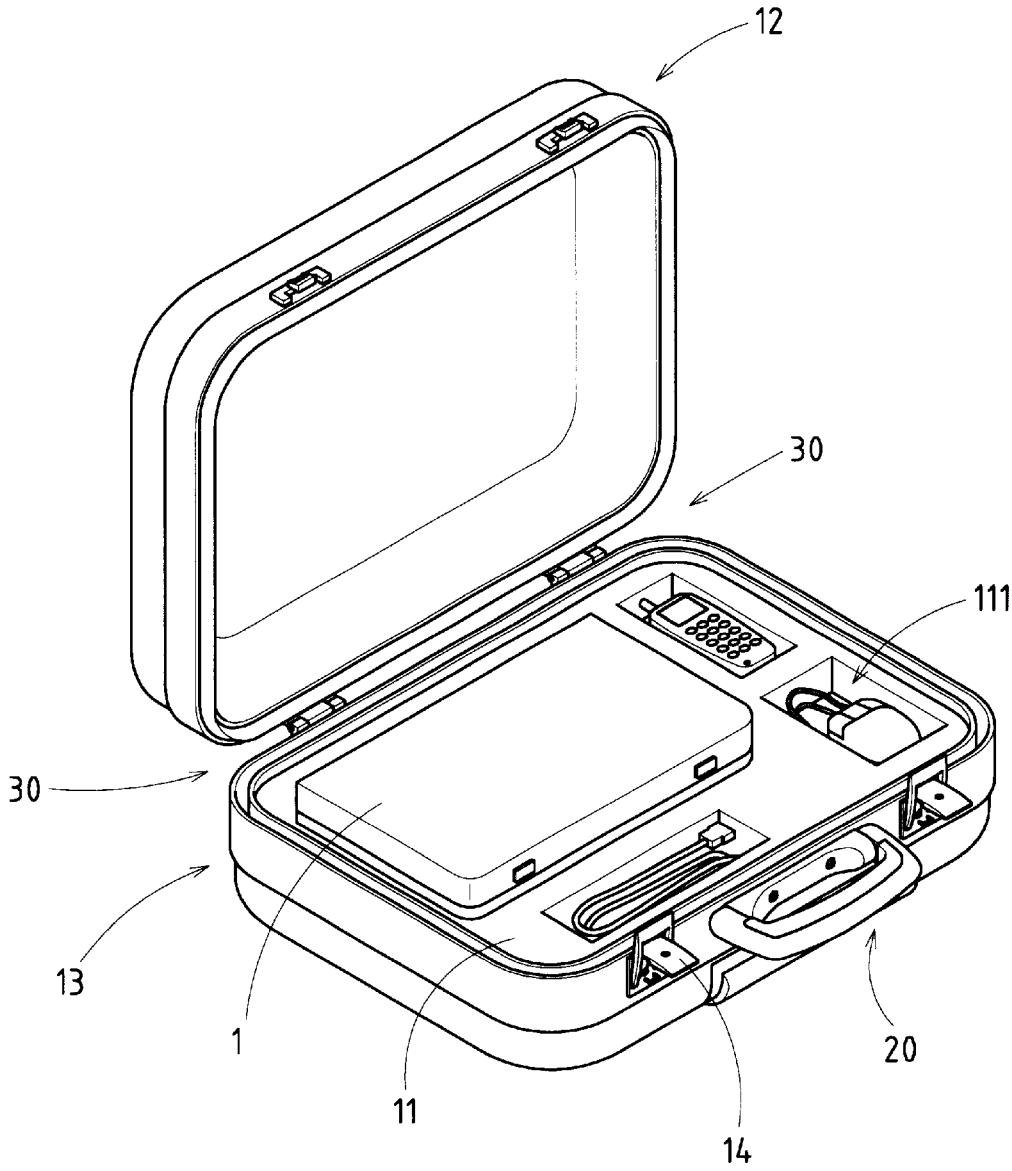
FIG. 2 shows a perspective view of the present invention with the shell being opened.
Figure 3:
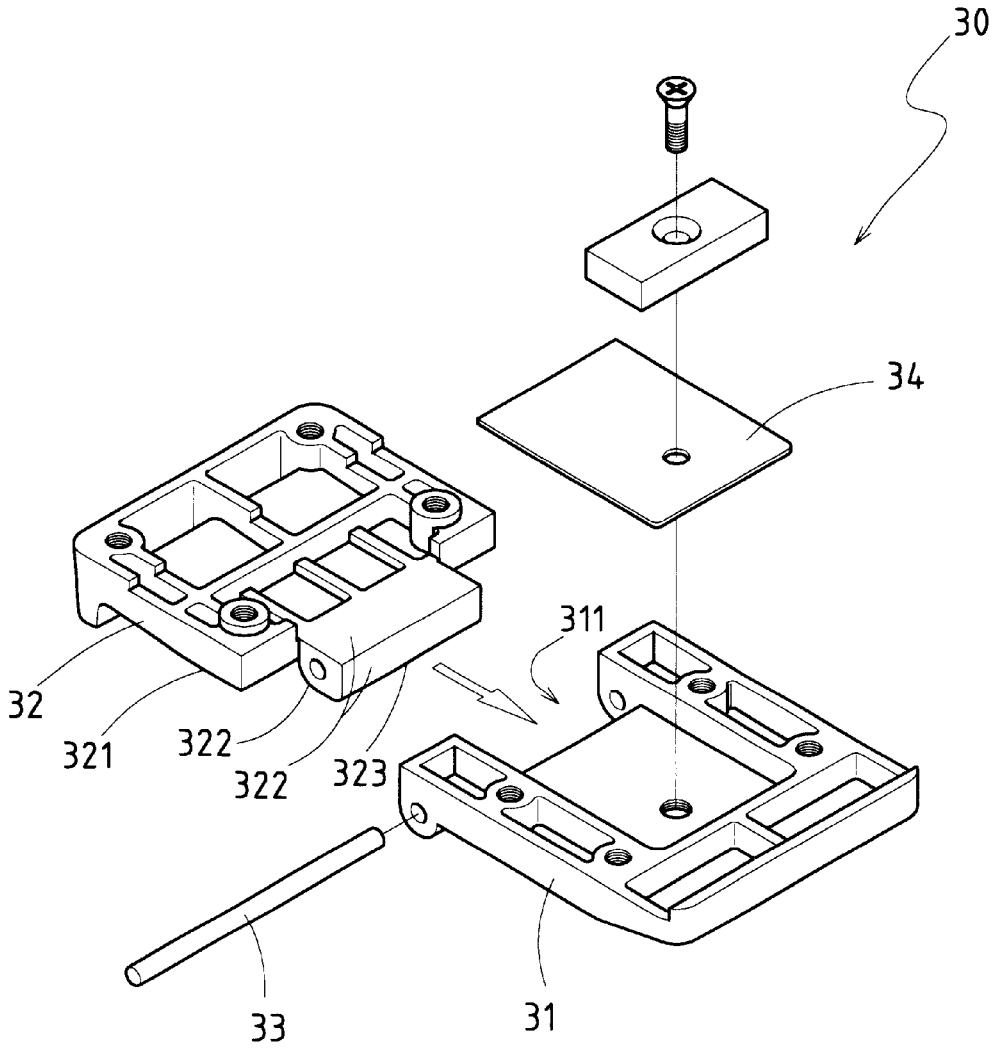
FIG. 3 shows an exploded view of the pivoting device of the present invention.
Figure 4:
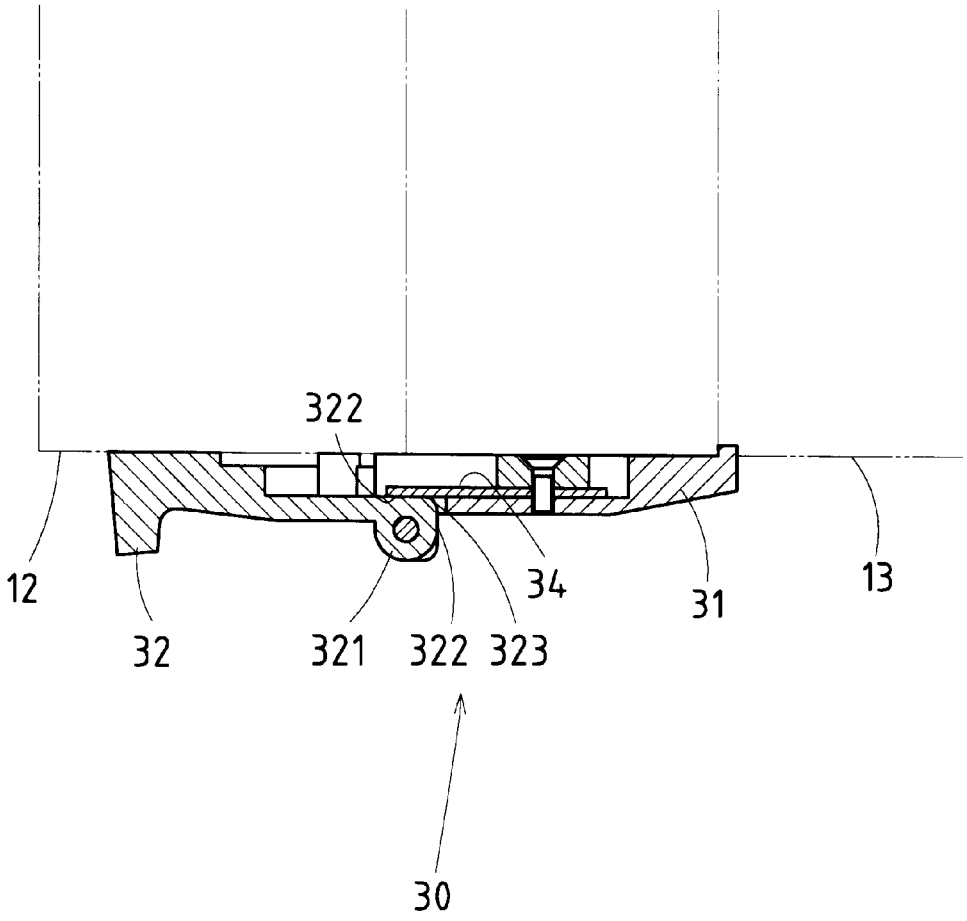
FIG. 4 shows a sectional view of the pivoting device of the present invention with the shell being closed.
Figure 5:
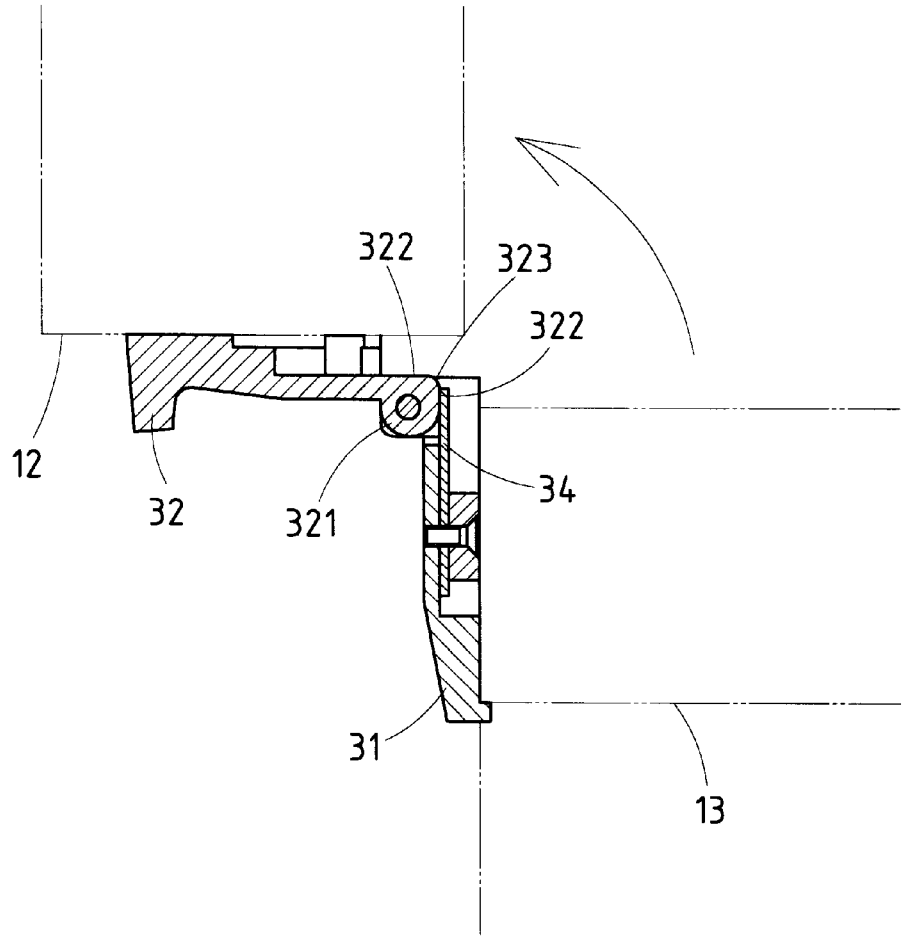
FIG. 5 shows a sectional view of the pivoting device of the present invention with the shell being opened.

As shown in FIGS. 1–5, a container embodied in the present invention comprises a shell 10, a shock-absorbing pad 11 disposed in the interior of the shell 10, and a handle member 20.

The shell 10 is formed of a cover piece 12 and a body piece 13, which are pivotally joined together by a pivoting member 30. The cover piece 12 and the body piece 13 are locked together by a locking device 14. The shock-absorbing pad 11 is provided with a plurality of receiving slots 111 for receiving and locating a precision electronic device 1. The pivoting member 30 is formed of a locating seat 31 and a movable seat 32. The locating seat 31 is provided at the center of one end thereof with a cut 311 for receiving a protuberance 321 of the movable seat 32 in conjunction with a pivot 33, thereby enabling the cover piece 12 to swivel toward or away from the body piece 13.

Figure 6:
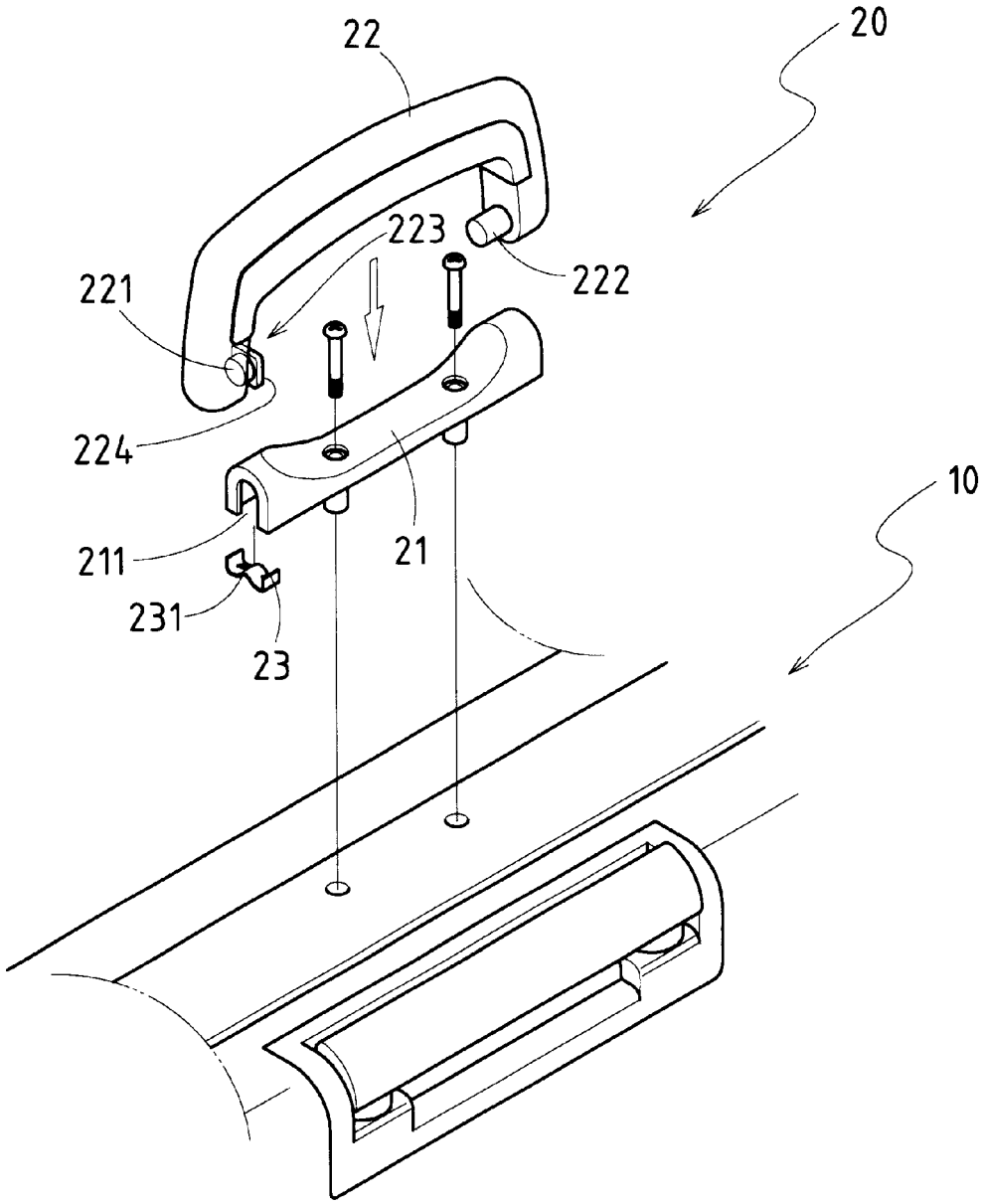
FIG. 6 shows an exploded view of the handle member and the shell of the present invention.
Figure 7:
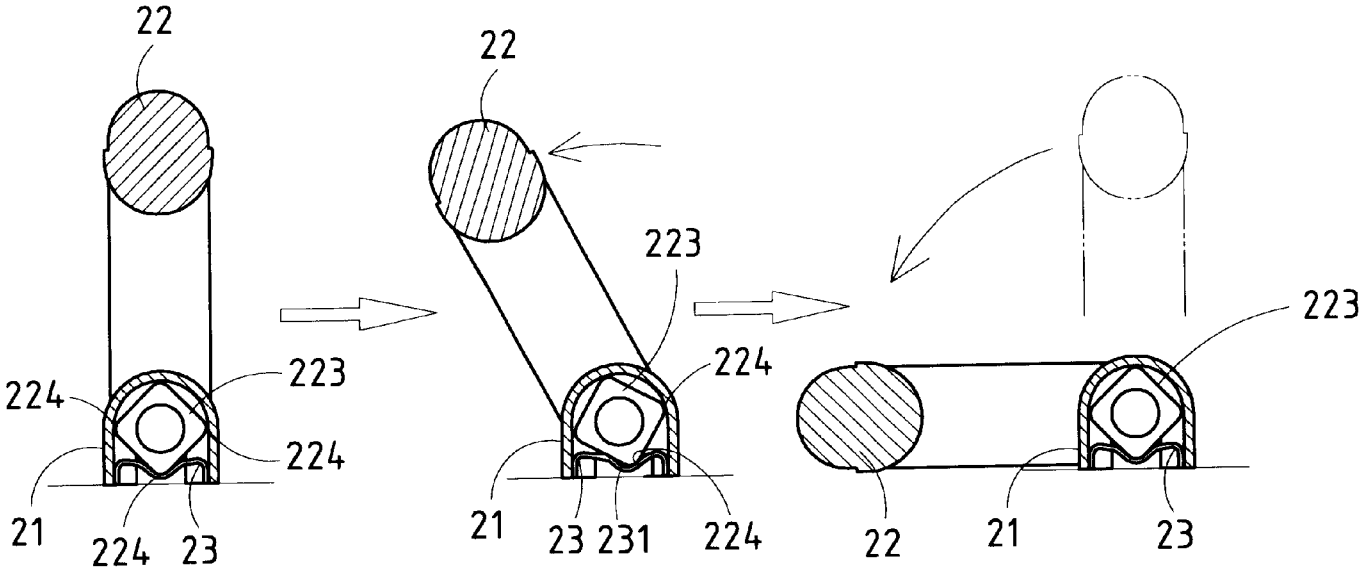
FIG. 7 shows a series of sectional schematic views of the handle being turned and located.

As shown in FIGS. 6 and 7, the handle member 20 is formed of a fixation seat 21, and a handle 22 which is fixed with the fixation seat 21. The fixation seat 21 is fastened with a top side of the shell 10.

Figure 8:
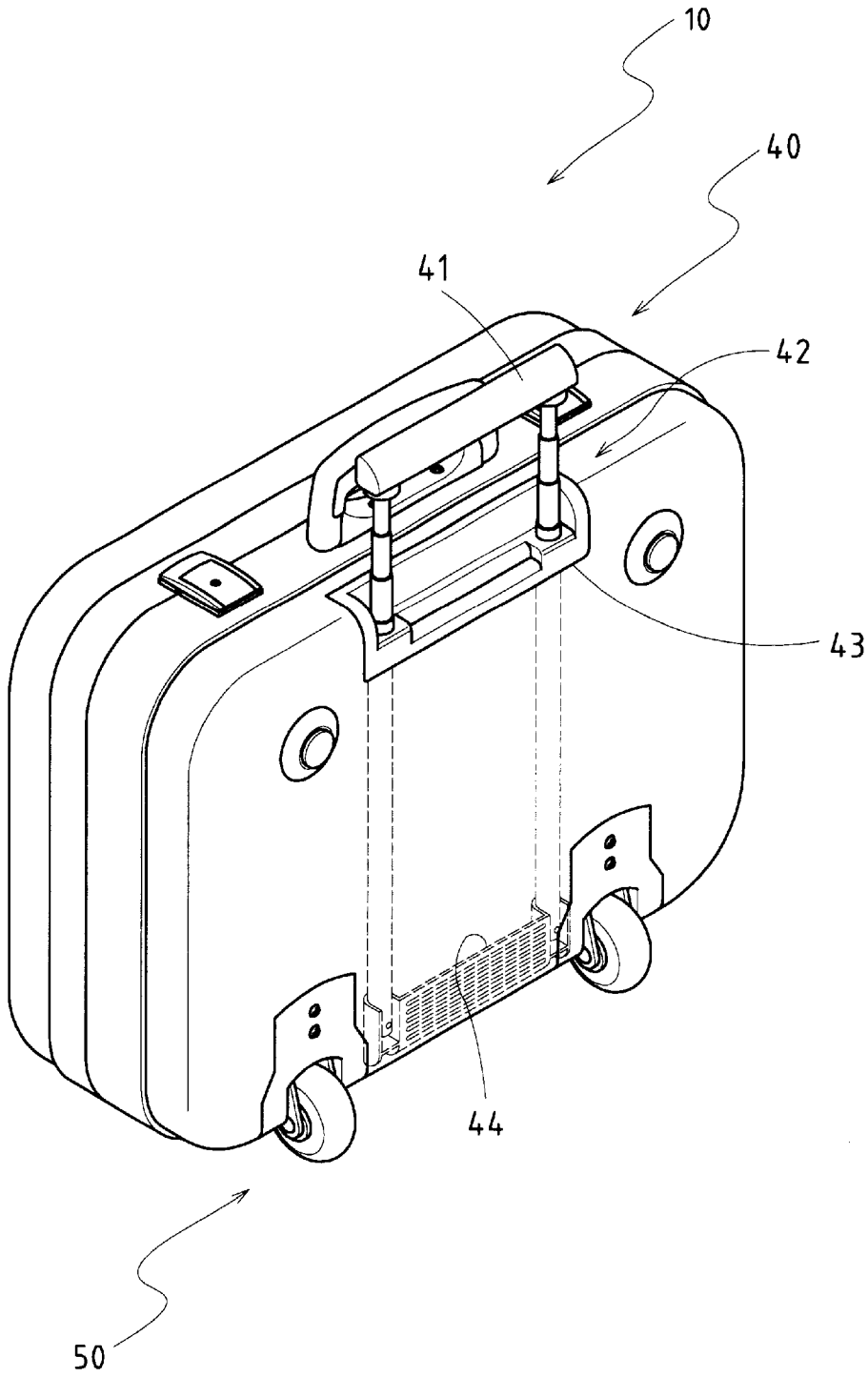
FIG. 8 shows a perspective view of the shell and the downsized pull rod of the present invention.
Figure 9:
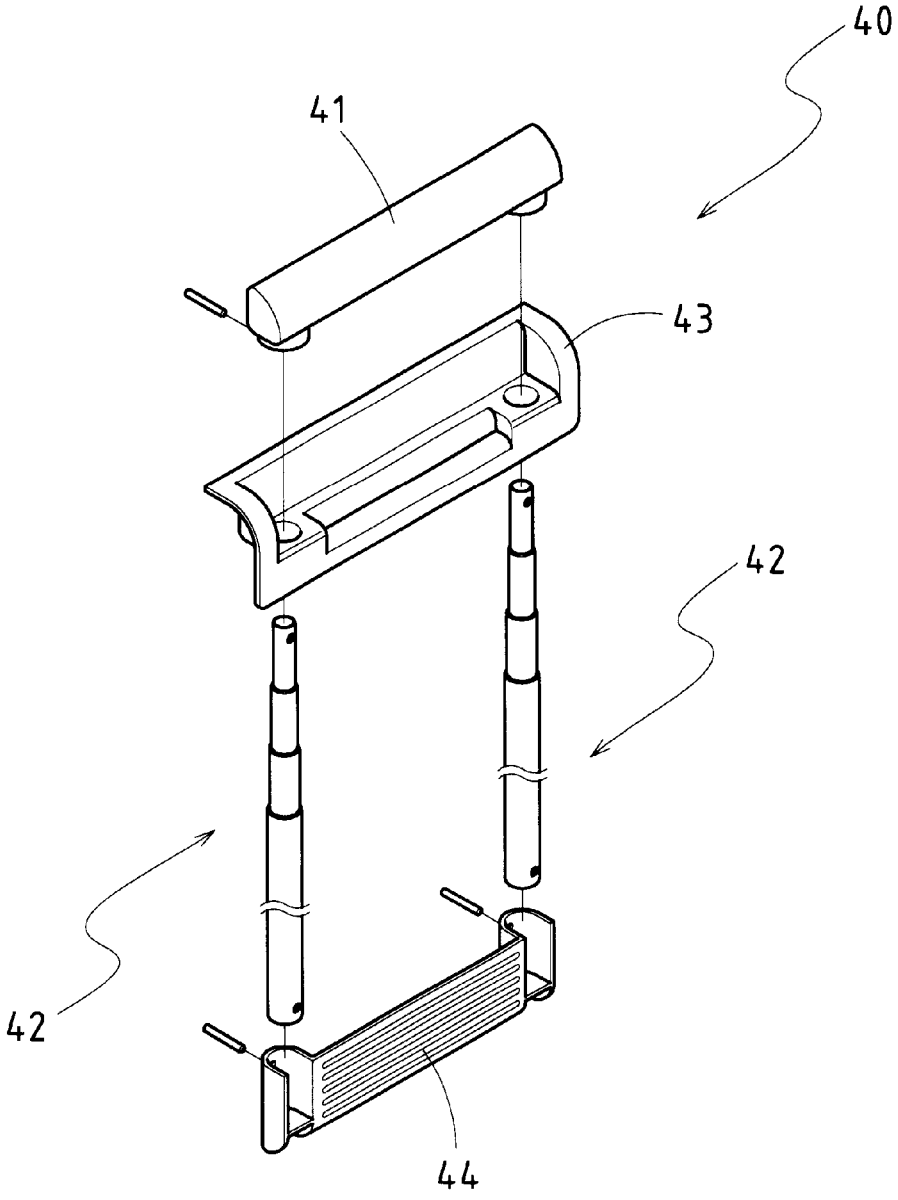
FIG. 9 shows an exploded view of the downsized pull rod and the shell of the present invention.
Figure 10:
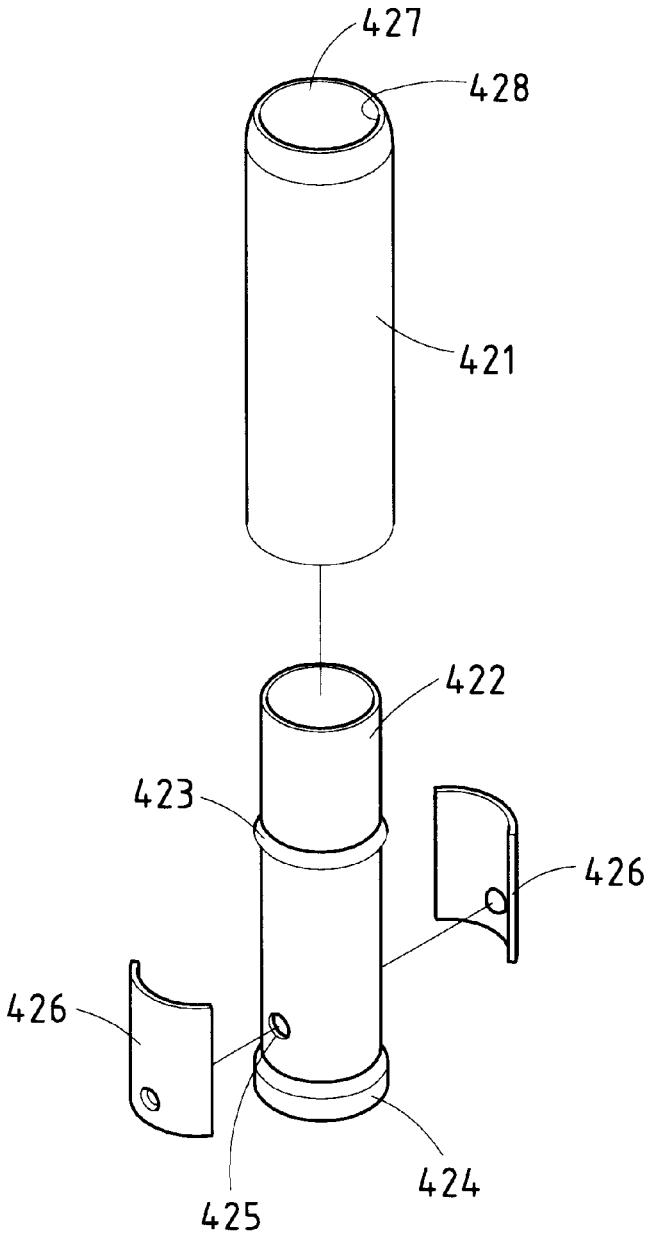
FIG. 10 shows an exploded view of an inner tube and an outer tube of the downsized pull rod of the present invention.
Figure 11:
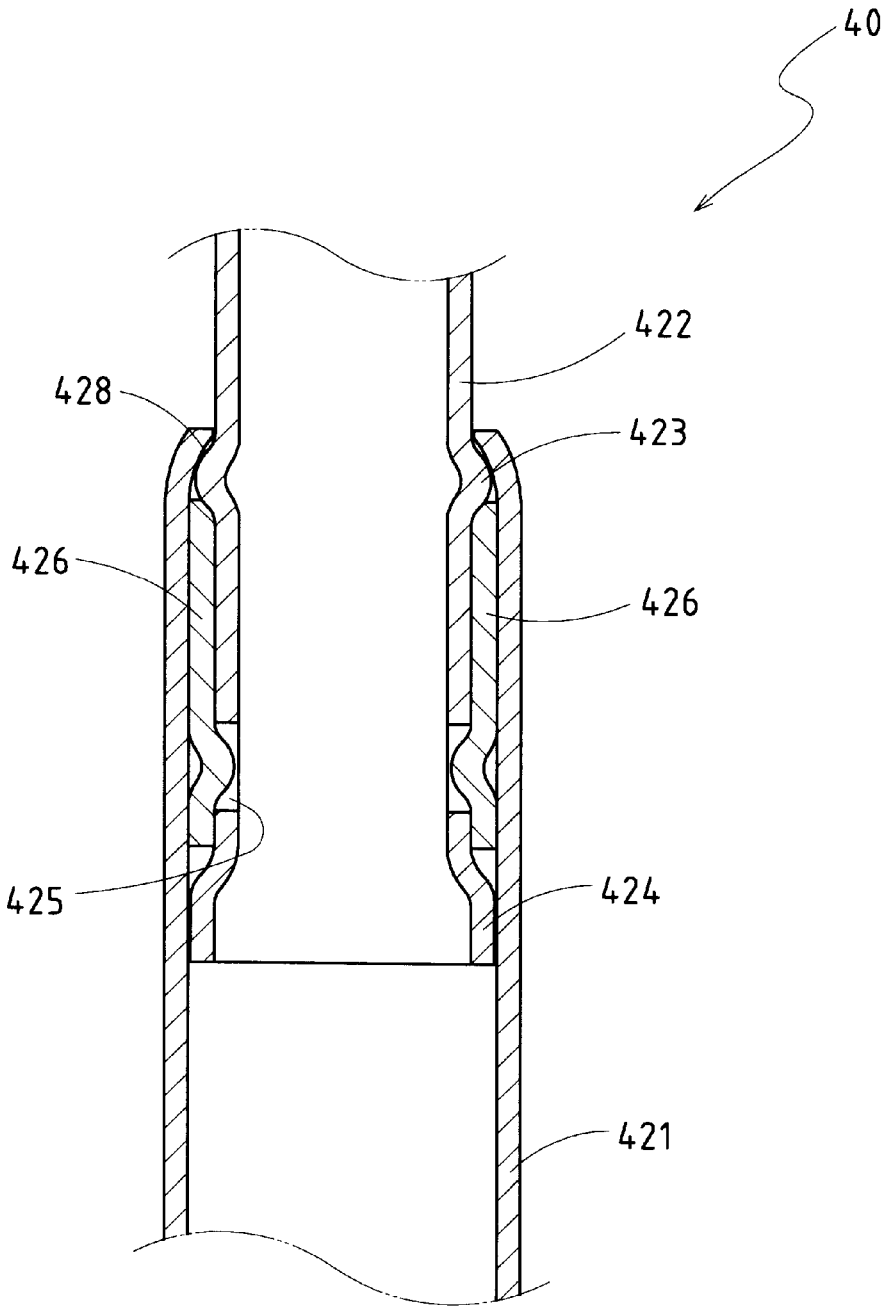
FIG. 11 shows a longitudinal sectional view of the inner tube and the outer tube of the downsized pull rod of the present invention.
Figure 12:
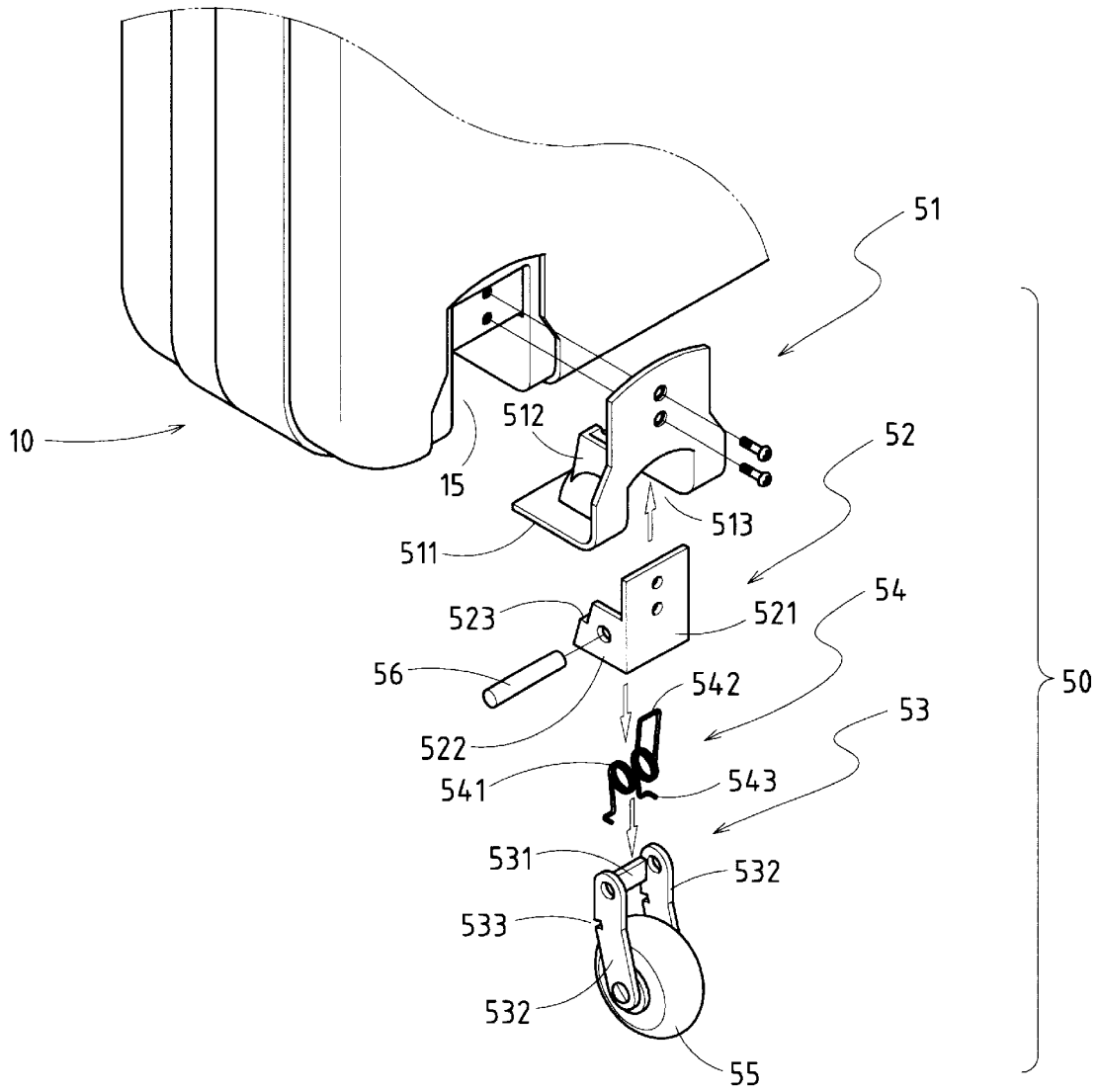
FIG. 12 shows an exploded view of the wheel member and the shell of the present invention.
Figure 13:
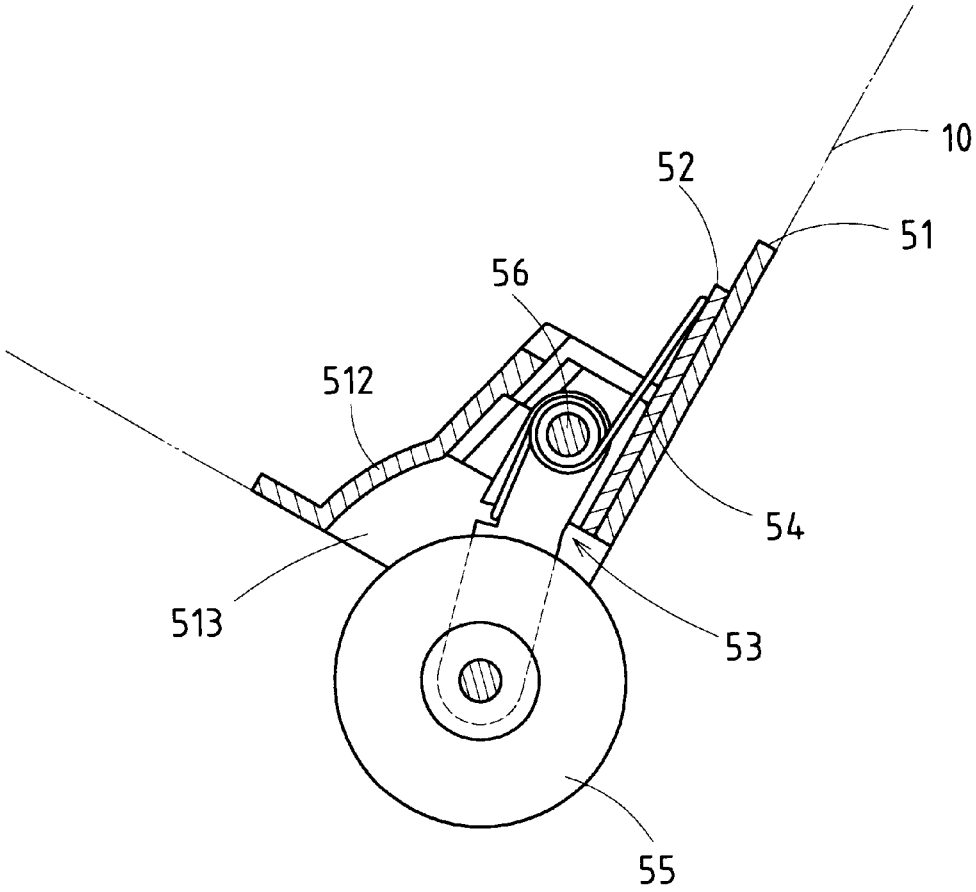
FIG. 13 shows a sectional view of the wheel member of the present invention.
Figure 14:
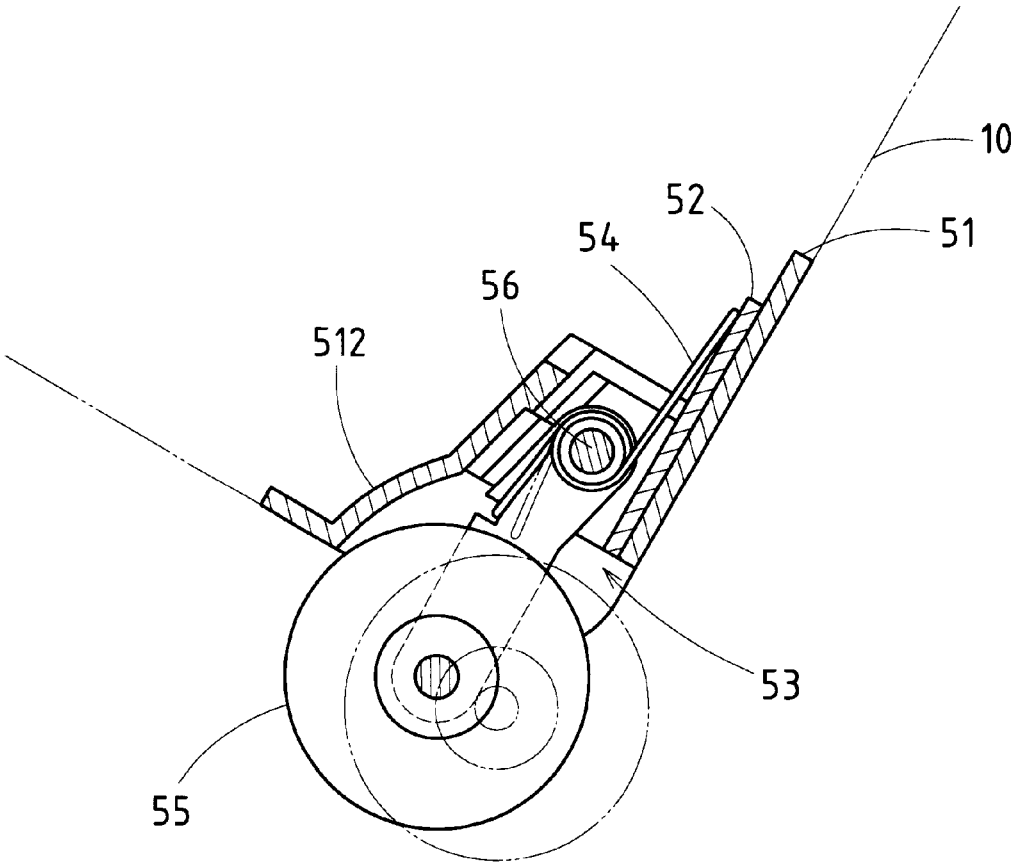
FIG. 14 shows a sectional schematic view of the wheel member of the present invention in the state of absorbing shock.

As shown in FIGS. 8 and 9, the shell 10 is provided with a downsized pull rod 40 and a wheel member 50.

The locating seat 31 is provided with an elastic piece 34 fastened therewith such that an outer end of the elastic piece 34 urges the bottom wall of the cut 311 of the locating seat 31. The protuberance 321 of the movable seat 32 has a polygonal cross section and a plurality of planar surfaces 322, with the juncture of two planar surfaces 322 forming an angled side 323. As the movable seat 32 swivels, it can be located step by step, thanks to the joint action of the planar surfaces 322, the angled side 323, and the elastic piece 34. As a result, the cover piece 12 can be swivelled by degrees.

As shown in FIGS. 1, 2, 3, 6, and 7, a multifunctional container of the present invention comprises a shell 10, a shock-absorbing pad 11 disposed in the interior of the shell 10 and a handle member 20 fastened to a top side of the shell 10.

The shell 10 is formed of a cover piece 12 and a body piece 13 fastened pivotally with the cover piece 12 by a pivoting device 30. The cover piece 12 and the body piece 13 are locked by a locking device 14. The shock-absorbing pad 11 is provided with a plurality of receiving slots 111 for locating a precision electronic device 1. The pivoting device 30 is formed of a locating seat 31 and a movable seat 32. The locating seat 31 is provided at the center of one end thereof with, a cut 311. The movable seat 32 is provided with a protuberance 321, which is fitted into the cut 311 of the locating seat 31 in conjunction with a pivot 33. The locating seat 31 is fastened with the body piece 13, whereas the movable seat 32 is fastened with the cover piece 12. The cover piece 12 can be swivelled toward or away from the body piece 13. The handle member 20 is formed of a fixation seat 21 and a handle 22 which is fastened to the fixation seat 21. The fixation seat 21 is mounted on a top side of the shell 10, and is provided at two ends with an inverted U-shaped hole 211. The handle 22 is provided at two ends with a pivot 221, 222. The first pivot 221 is provided at an outer end with a polygonal block 223 having a plurality of corners 224. The handle 22 is retained at both ends in the holes 211 of the fixation seat 21 in conjunction with the pivots 221 and 222. The fixation seat 21 is provided in one of the holes 211 with an elastic piece 23 which is provided at the center with an inverted triangular slot 231 in contact with the corner 224 of the polygonal block 223 of the handle 22. As the handle 22 is turned on the pivots 221 and 222, the handle 22 can be turned step by step due to the joint action of the corners 224, the elastic piece 23, and the inverted triangular slot 231.

As shown in FIGS. 1, 2, 3, 6, 8, 9, 10, and 11, a container of the present invention comprise a shell 10, a shock-absorbing pad 11 disposed in the interior of the shell 109 and a handle member 20 mounted on a top side of the shell 110.

The shell 10 is formed of a cover piece 12 and a body piece 13, which are pivoted together by a pivoting device 30 and are provided with a locking device 14. The shock-absorbing pad 11 is provided with a plurality of receiving slots 111 for locating a precision electronic device 1. The pivoting device 30 is formed of a locating seat 31 and a movable seat 32. The locating seat 31 is provided at the center of one end with a cut 311. The movable seat 32 is provided with a protuberance 321 which is pivoted in the cut 311 by a pivot 33. The locating seat 31 is fastened with the body piece 13 of the shell 10, while the movable seat 32 is fastened with the cover piece 12 of the shell 10. The cover piece 12 can be thus swivelled away from or toward the body piece 13. The handle member 20 is formed of a fixation seat 21 and a handle 22 fastened with the fixation seat 21 which is mounted on the top side of the shell 10. The shell 10 is provided with a downsized pull rod 40, and a wheel member 50. The downsized pull rod 40 has a grip 41, which is fastened with two expandable tubular members 42. The tubular members 42 are fastened with the bottom seats 44 of the inner side wall of the shell 10 via a top seat 43 which is mounted on the top of the side of the shell 10. The tubular members 42 are formed of an outer tube 421 and an inner tube 422 which is provided in the outer wall of the bottom end with an upper projected ring 423 and a lower projected ring 424. Located in proximity of the projected rings 423 and 424 are two holes 425 for retaining a guide piece 426, so as to locate the inner tube 422 in the outer tube 421. The outer tube 421 has an upper end port 427 which is provided with a stop ring 428 for stopping the upper projected ring 423 of the inner tube 422 at the time when the inner tube 422 is pulled out of the outer tube 421 via the upper end port 427 of the outer tube 421, thereby preventing the separation of the inner tube 422 from the outer tube 421. The outer diameters of the upper projected ring 423 and the lower projected ring 424 are approximately corresponding to the inner diameter of the outer tube 421, thereby preventing the inner tube 422 from swaying inside the outer tube 421.

As shown in FIGS. 1, 2, 3, 6, 12, 13, and 14, a container of the present invention comprises a shell 10, a shock-absorbing pad 11 disposed in the interior of the shell 10, and a handle member 20 mounted on a top side of the shell 10. The shell 10 is formed of a cover piece 12 and a body piece 13, which are fastened pivotally by a pivoting device 30, and are provided with a locking device 14. The shock-absorbing pad 11 is provided with a plurality of receiving slots 111 and a space for receiving a precision electronic device 1. The pivoting device 30 is formed of a locating seat 31 and a movable seat 32. The locating seat 31 is provided at the center of one end with a cut 311. The movable seat 32 is provided with a protuberance 321, which is pivoted in the cut 311 by a pivot 33. The locating seat 31 is fastened with the body piece 13 of the shell 10 while the movable seat 32 is fastened with the cover piece 12 of the shell 10. The cover piece 12 can be swivelled away from or toward the body piece 13. The handle member 20 is formed of a fixation seat 21 and a handle 22 fastened to the fixation seat 21.

The fixation seat 21 is fastened with the top of the shell 10. The shell 10 is provided in one side with a downsized pull rod 40, and in the bottom side with a wheel member 50. The wheel member 50 is disposed in a recess 15 of the bottom side of the shell 10 and is formed of a wheel seat 51, a wheel frame 52, a wheel arm 53, a rotary arm spring 54, and a wheel 55. The wheel seat 51 has an L-shaped plate 511 which is provided in the inner corner with a hollow shell seat 512, and in the outer corner with a wheel chamber 513. The wheel frame 52 has a face plate 521 which is provided with two parallel protective plates 522 bending at a right angle in the same direction. The wheel arm 53 has a cross plate 531 with two sides bending in the same direction at a right angle to form two parallel support arms 532, each having a top end jutting out of the top of the cross plate 531. The bottom ends of the support arms 532 extend downward and slantingly for fastening pivotally the wheel 55. The top ends of the support arms 532 and the cross plate 531 are located between the two protective plates 522. The center coil 541 of the rotary arm spring 54 is disposed between the top ends of the two support arms 532. The protective plates 522, the support arms 532, and the center coil 541 of the rotary spring 54 are pivoted by a pivot 56 such that a top arm of force resistance 542 puts a pressure on the inner side of the face plate 521 of the wheel frame 52, and that a bottom arm of force resistance 543 puts a pressure on a recess 533 of the support arms 532. In the normal state, the wheel arm 53 is exerted on by the spring force of the rotary arm spring 54 to move toward the bottom of the face plate 521 of the wheel frame 52. The wheel frame 52, the wheel arm 53, the rotary arm spring 54, and the wheel 55 are disposed in the shell seat 512 via the wheel chamber 513 such that the wheel 55 is slightly located at the outer corner of the wheel chamber 513. When the wheel 55 is in motion, the wheel arm 53 is actuated to swivel, so as to enable the wheel 55 to displace in the wheel chamber 513 to absorb shock. The wheel arm 53 is forced by the spring force of the rotary arm spring 54 to return to its original position.

As shown in FIGS. 1 2, 3, 6, 15, and 16, a multifunctional container of the present invention comprises a shell 10, a shock-absorbing pad 11 disposed in the interior of the shell 10, and a handle member 20 mounted on a top side of the shell 10.

The shell 10 is formed of a cover piece 12 and a body piece 13, which are fastened pivot-ally by a pivoting device 30 and provided with a locking device 14.

The shock-absorbing pad 11 is provided with a plurality of receiving slots 111 and a space for receiving a precision electronic device 1.

The pivoting device 30 is formed of a locating seat 31 and a movable seat 32. The locating seat 31 is provided at the center of one end with a cut 311. The movable seat 32 is provided with a protuberance 321 by which the movable seat 32 is pivoted with the locating seat 31 in conjunction with a pivot 33 such that the protuberance 321 is fitted into the cut 311. The locating seat 31 is fastened with the body piece 13 of the shell 10, whereas the movable seat 32 is fastened with the cover piece 12 of the shell 10.

The handle member 20 is formed of a fixation seat 21 and a handle 22. The fixation seat 21 is mounted on the top side of the shell 10. The handle 22 is fastened pivotally with the fixation seat 21.

The shell 10 is provided in one side with a downsized pull rod 40, in the bottom side with one or two wheel members 50.

Figure 15:
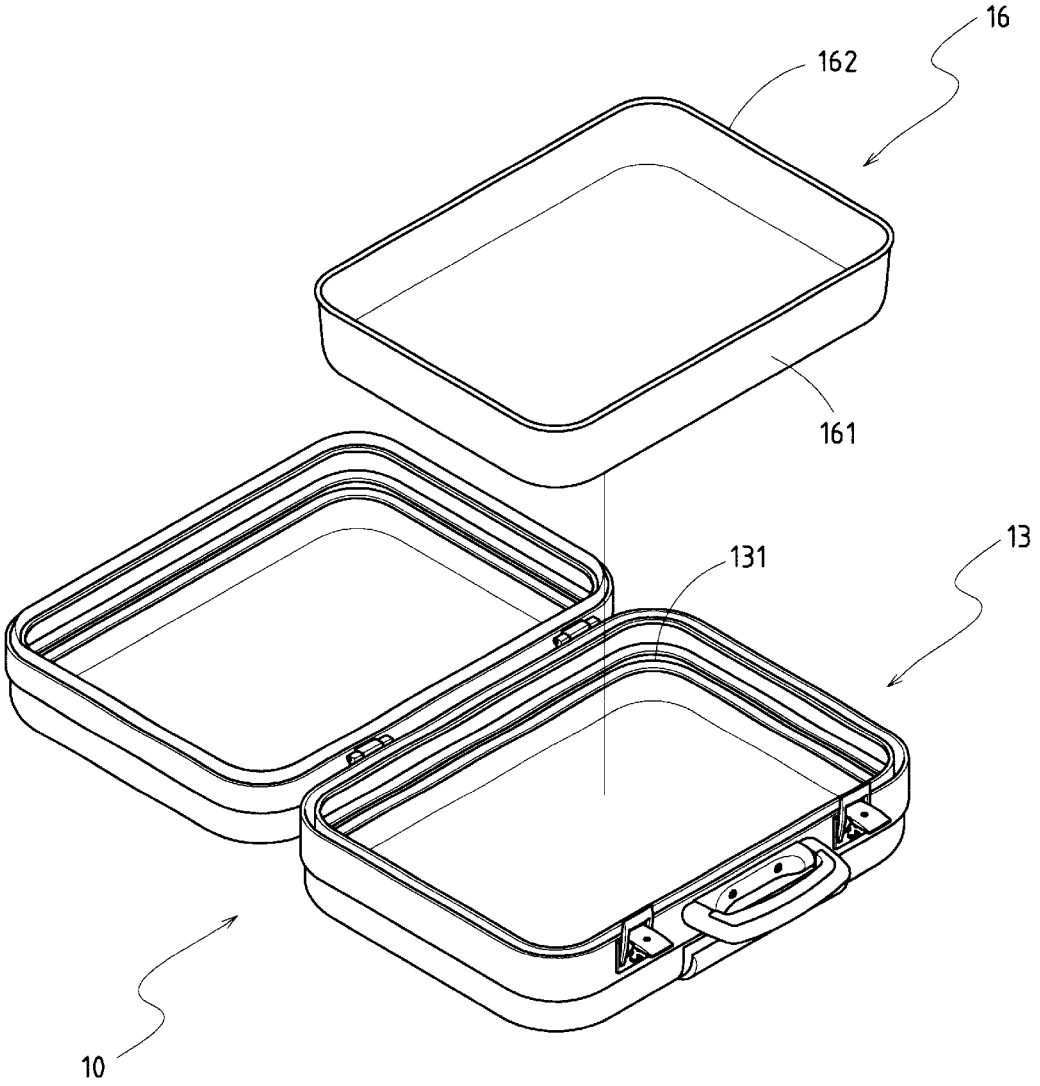
FIG. 15 shows an exploded view of the shell and the lining of the present invention.
Figure 16:
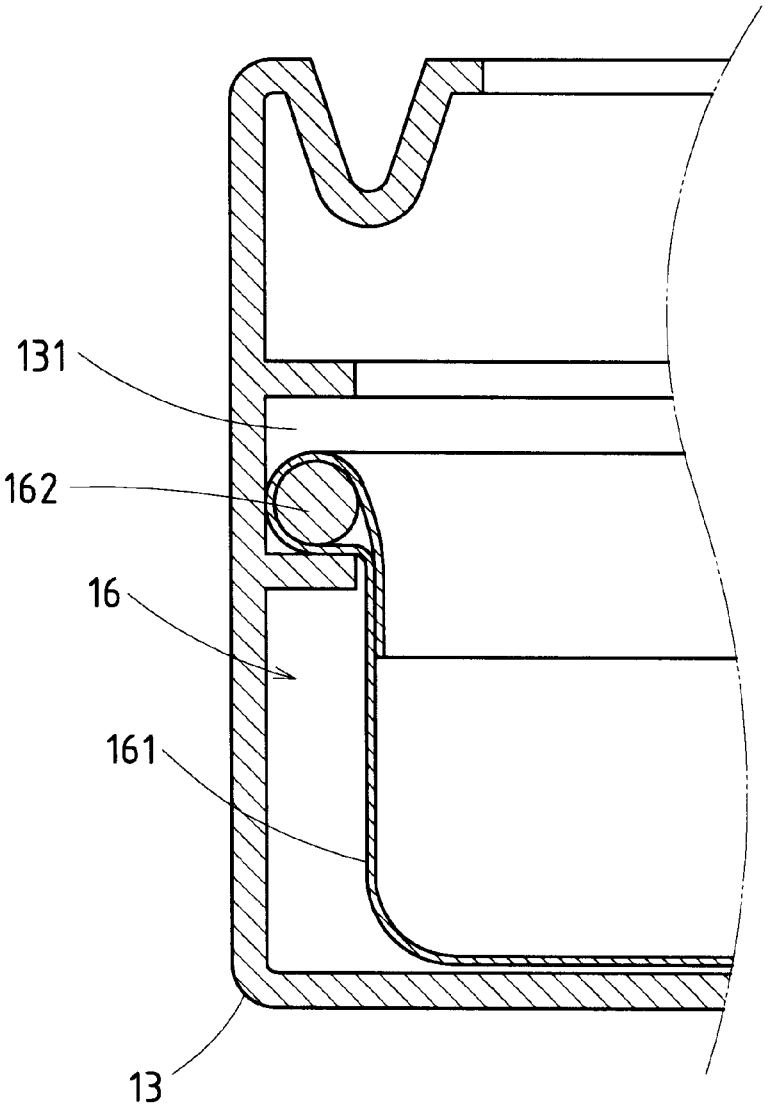
FIG. 16 shows a sectional view of the shell and the lining of the present invention.
Figure 17:
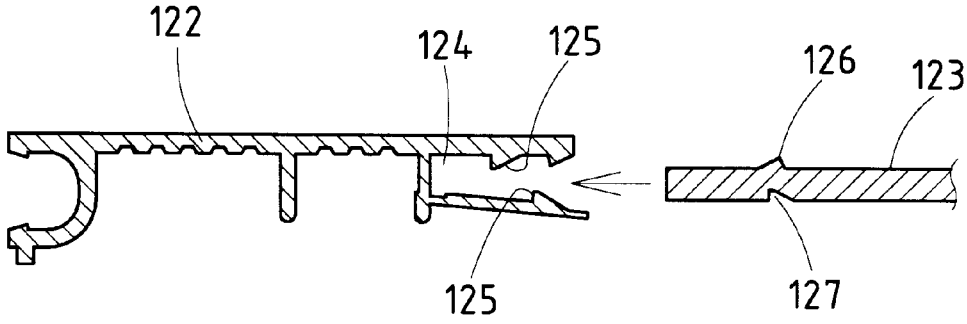
FIG. 17 shows an exploded view of the shell of the present invention.
Figure 18:
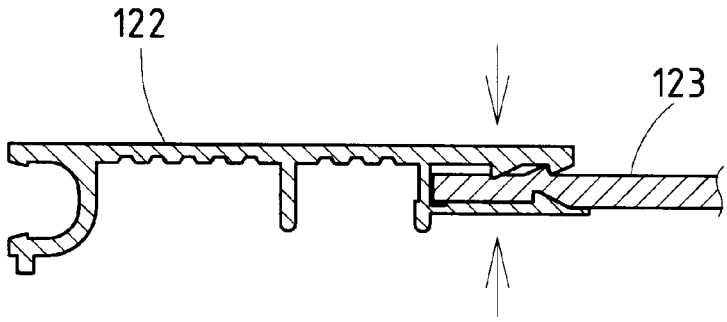
FIG. 18 shows a sectional view of the shell of the present invention.
Figure 19:
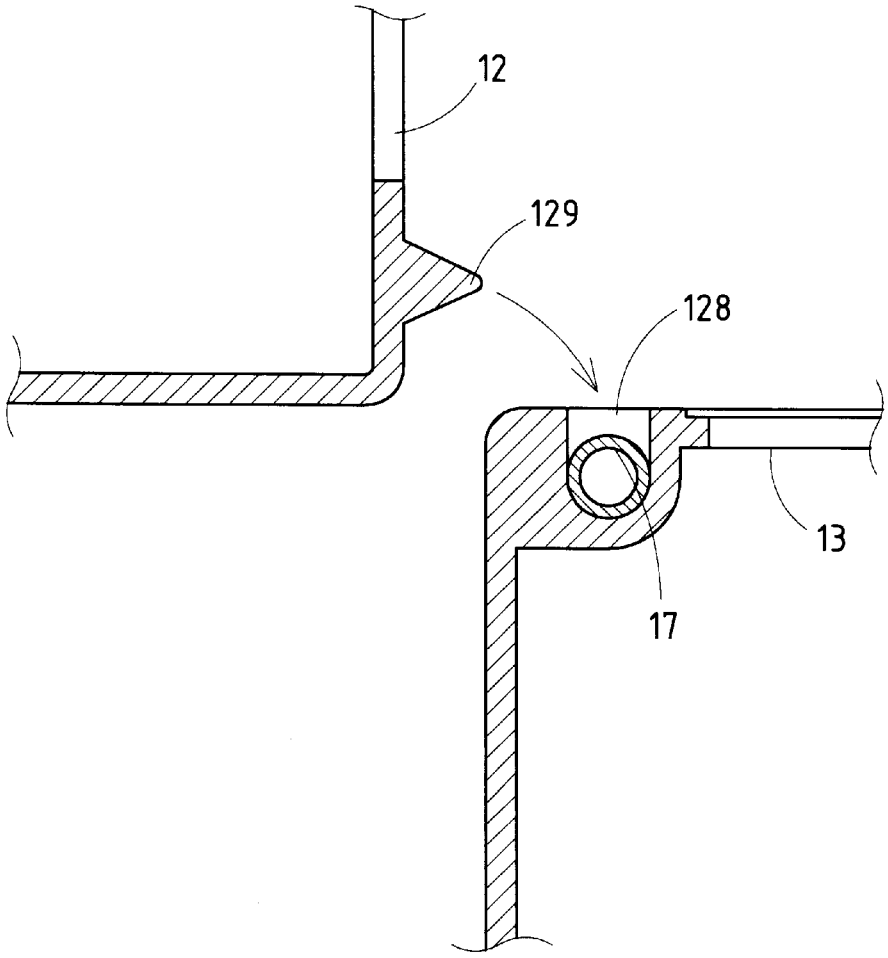
FIG. 19 shows an another exploded view of the shell of the present invention.
Figure 20:
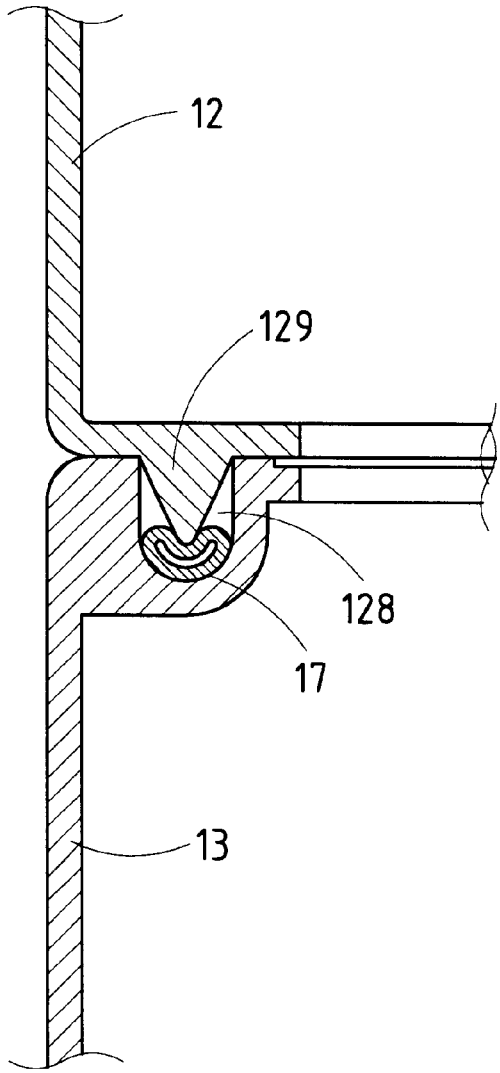
FIG. 20 shows a sectional view of the shell of the present invention.

The cover piece 12 or body piece 13 of the shell 10 is provided with an inner cushion 16, which is formed of a frame 161 and an elastic strip 162 extending along the top rim of the frame 161, as shown in FIG. 15. The body piece 13 is provided in the inner wall with a groove 131. The inner cushion 16 is disposed in the interior of the body piece 13 such that the elastic strip 162 of the inner cushion 16 is retained in the groove 131 of the body piece 13.

As shown in FIGS. 1, 2, 17, and 18, a multifunctional container of the present invention comprises a shell 10, which is formed of a cover piece 12 and a body piece 13. The cover piece 12 and the body piece 13 are respectively formed of an outer frame 122 and an inner frame 123. The outer frame, 122 is provided with a receiving slot 124 which is in turn provided with two opposite hooks 125. The inner frame 123 is provided with a retaining projection 126 or retaining recess 127. The inner frame 123 is joined with the outer frame 122 such that the retaining projection 126 or retaining recess 127 of the inner frame 123 is retained by the hook 25 of the receiving slot 124 of the outer frame 122.

As shown in FIGS. 1, 2, 19, and 20, a multifunctional container of the present invention comprises a shell 10 which is formed of a cover piece 12 and a body piece 13. The cover piece 12 and the body piece 13 are respectively provided with a frame slot 128 and a frame projection 129. A waterproof strip 17 is disposed in the frame slot 128. As the cover piece 12 is joined with the body piece 13, the frame projection 129 is fitted into the frame slot 128 to press against the waterproof strip 17.

As shown in FIGS. 1–20, a container of the present invention comprises a shell 10, which is formed of a cover piece 12 and a body piece 13. The cover piece 12 and the body piece 13 are pivotally fastened together and are formed of an outer frame 122 and an inner frame 123. The outer frame 122 is provided at one end with a receiving slot 124, which is in turn provided with two retaining hooks 125 opposite in location to each other. The inner frame 123 is provided with a retaining projection 126 or retaining recess 127. The inner frame 123 is joined with the outer frame 122 such that the retaining projection 126 or retaining recess 127 is engaged with the retaining hook 125 of the outer frame 122. The cover piece 12 and the body piece 13 of the shell 10 are provided respectively with a frame slot 128 and a frame projection 129. A waterproof strip 17 is received in the frame slot 128. As the cover piece 12 is joined with the body piece 13, the frame projection 129 is fitted into the frame slot 128 to press against the waterproof strip 17.

A shock-absorbing cushion 11 is removably disposed in the interior of the body piece 13 and is provided with a plurality of receiving slots 111. The cushion 11 has a space for locating a high precision electronic device 1.

A handle member 20 is formed of a fixation seat 21, and a handle 22 mounted pivotally on the fixation seat 21 which is mounted on the top side of the shell 10. The fixation seat 21 is provided at two ends with an inverted U-shaped hole 211. The handle 22 is provided at two ends with a pivot 221, 222. The first pivot 221 is provided at an outer end with polygonal block 223 having a plurality of corners 224. The handle 22 is pivoted in the holes 211 of the fixation seat 21 by the pivots 221 and 222. The hole 211 of one end of the fixation seat 21 is provided with an elastic piece 23 which is provided in the center with an inverted triangular slot 231. The corner 224 of the polygonal block 223 of the handle 22 rests against the inverted triangular slot 231. When the handle 22 is turned step by step on the pivots 221 and 222, the corners 224 of the polygonal block 223 of the handle 22 are engaged one by one with the inverted triangular slot 23 of the elastic piece 23.

A pivoting device 30 is formed of a locating seat 31 and a movable seat 32 pivoted with the locating seat 31. The locating seat 31 is provided at the center of one end with a cut 311. The movable seat 32 is provided with a protuberance 321, which is pivoted in the cut 311 of the locating seat 31 by a pivot 33. The locating seat 31 is fastened with the body piece 13 of the shell 10. The movable seat 32 is fastened with the cover piece 12 of the shell 10. The locating seat 31 is provided in the inner side with an elastic piece 34 with an outer end thereof extending to the bottom of the cut 311. The protuberance 321 of the movable seat 32 has a polygonal cross section and a plurality of planar surfaces 322, with the juncture of two planar surfaces 322 forming an angled side 323. As the movable seat 32 is swivelled, the elastic piece 34 acts with the planar surfaces 322 and the angled side 323 of the protuberance 321 to enable the movable seat 32 to be swivelled by degrees.

A downsized pull rod 40 is formed of a hand grip 41 and two expandable tubular members 42 fastened with the hand grip 41 such that the tubular members 42 are fixed with a bottom seat 44 located in the shell 10 via a top seat 43 of the shell 10. The tubular members 42 are formed of an outer tube 421 and an inner tube 422 slidably fitted into the outer tube 421. The inner tube 422 is provided in the outer wall of the bottom end thereof with an upper projected ring 423 and a lower projected ring 424. Located in proximity of the projected rings 423 and 424 are two holes 425 for retaining a guide piece 426. When the inner tube 422 is fitted into the outer tube 421, only the projected rings 423,424, and the guide piece 426 come in contact with the inner wall of the outer tube 421. The outer tube 421 has an upper end port 427 which is provided with a stop ring 428 serving to stop the upper projected ring 423 of the inner tube 422 at such time when the inner tube 422 is pulled out of the outer tube 421 via the upper end port 427, thereby preventing separation of the inner tube 422 from the outer tube 421. In light of the projected rings 423 and 424 of the inner tube 422, the inner tube 422 is prevented from swaying inside the outer tube 421.

One or more wheel members 50 are mounted in a recess 15 of the bottom of the shell 10 and are formed of a wheel seat 51, a wheel frame 52, a wheel arm 53, a rotary arm spring 54, and a wheel 55. The wheel seat 51 is formed of a plate 511 having a hollow shell seat 512 and a wheel chamber 513. The wheel frame 52 is formed of a face plate 521 which is provided with two protective plates 522 extending at a right angle in the same direction from the face plate 521. The protective plates 522 are provided with two stop pieces 523 opposite to each other and extending at a right angle from the protective plates 522. The wheel arm 53 is formed of a cross plate 531 and two support arms 532 parallel to each other and extending at a right angle from the cross plate 531 such that the top ends of the two support arms 532 are jutted out of the cross plate 531, and that the bottom ends of the two support arms 532 are extended downwards and slantingly to facilitate the pivoting of the wheel 55. The top ends of the two support arms 532 and the cross plate 531 are located between the two protective plates 522. The rotary arm spring 54 has a center coil 541, which is disposed between the top ends of the two support arms 532 in conjunction with a pivot 56. The top resistance force of arm 542 of the rotary arm spring 54 puts a pressure on the face plate 521 of the wheel frame 52, whereas the bottom resistance force of arm 543 of the center coil 541 exerts a pressure on a recess 533 of the support arms 532. The wheel arm 53 is exerted on by the spring force of the spring 54 to lean toward the bottom of the face plate 521 of the wheel frame 52. The wheel frame 52 is inserted into the shell seat 512 via the wheel chamber 513 such that the face plate 521 is fastened with the plate 511 . The wheel 55 is oriented by the wheel arm 53 to locate slightly out of the wheel chamber 513. As the shell 10 is slantingly moved on the wheel 55 on a surface, the wheel arm 53 is actuated by the wheel 55 to swivel, so as to enable the wheel 55 to displace in the wheel chamber 513 to absorb shock. The wheel arm 53 is provided by the rotary arm spring 54 with a recovery spring force enabling the wheel arm 53 to return to its original position after being actuated to swivel.

Figure 21:
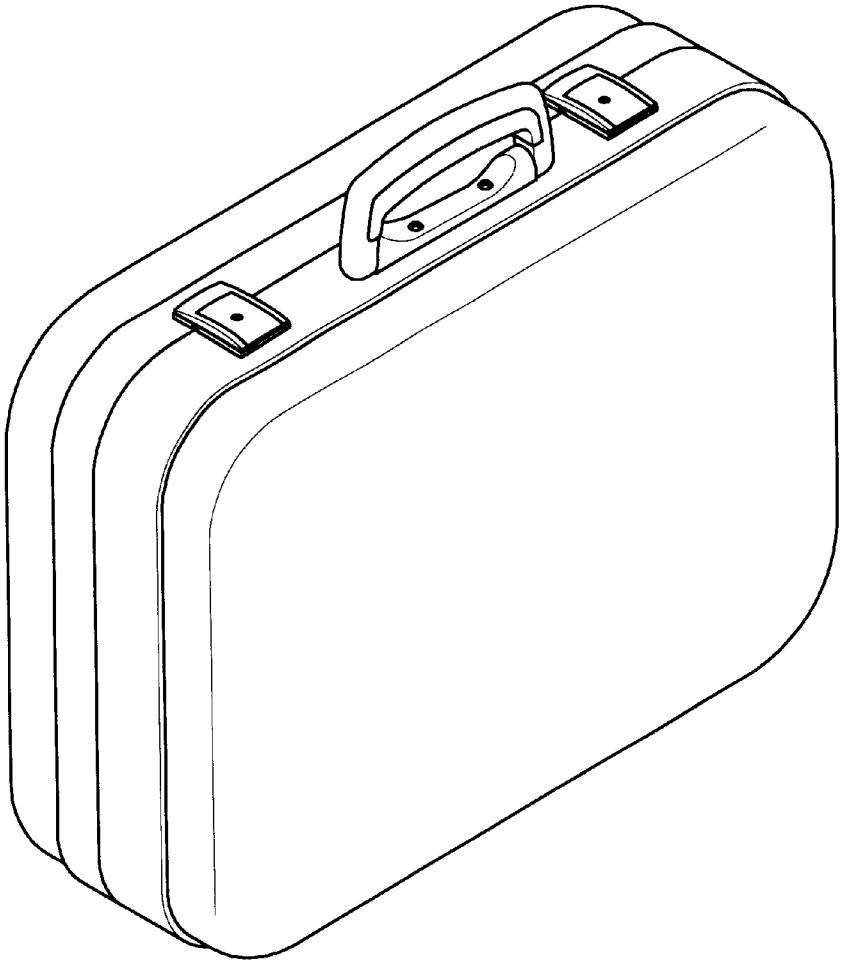
FIG. 21 shows a perspective view of a second preferred embodiment of the present invention.

As shown in FIG. 21, a multifunctional container of the present invention comprises a shell 10 which is devoid of the downsized pull rod 40 and the wheel member 50.

Figure 22:
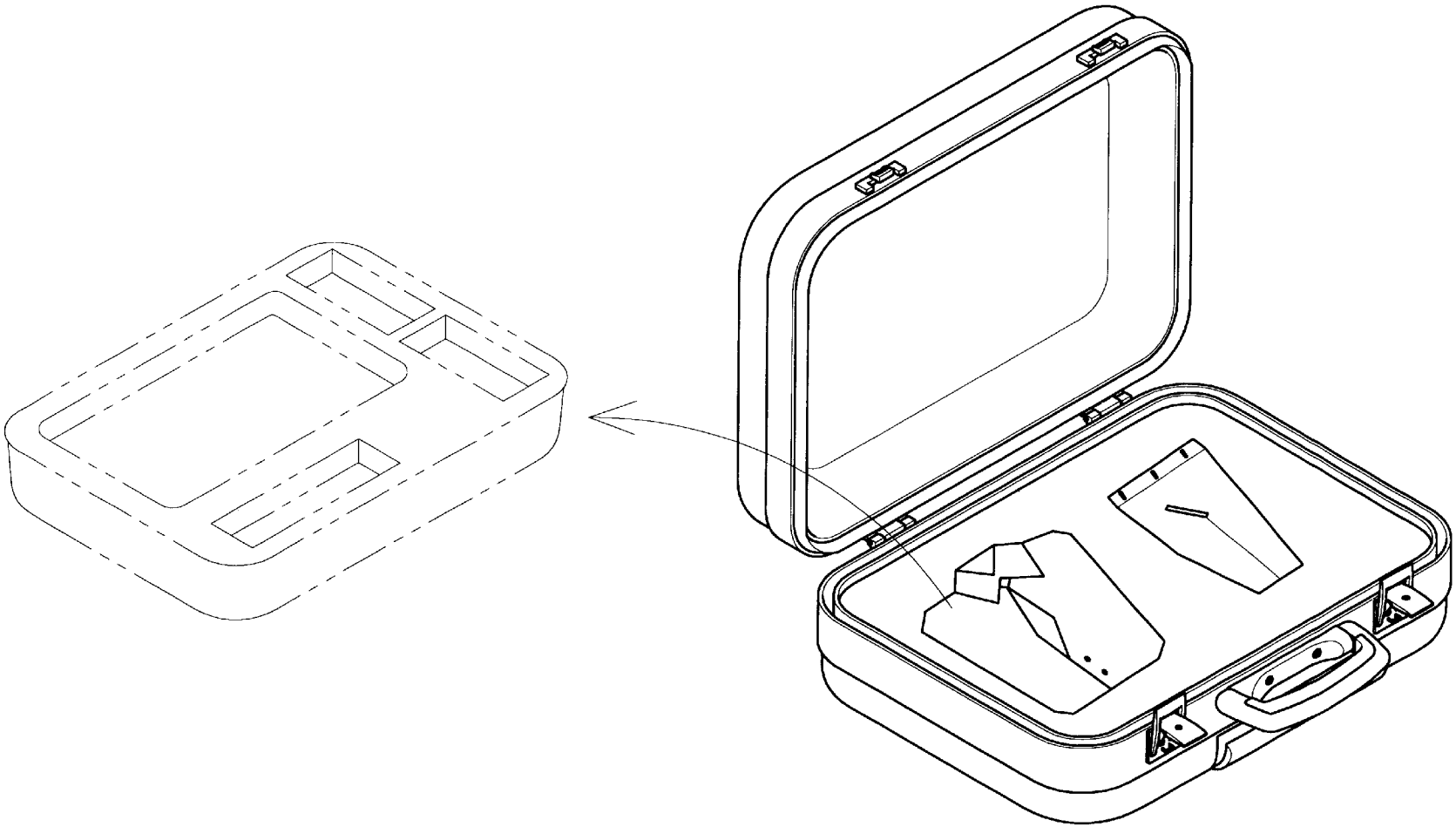
FIG. 22 shows a perspective view of a third preferred embodiment of the present invention.

As shown in FIG. 22, a multifunctional container of the present invention comprises a shell 10 which is provided in the interior with a shock-absorbing pad 11. The shock-absorbing pad 11 is removably disposed in the interior of the shell 10.

The advantages of the present invention are described hereinafter.

The shock-absorbing pad 11 of the interior of the shell 10 serves to protect and locate the high precision electronic device 1. As the cover piece 12 of the shell 10 is swiveled on the pivoting device 30 to open up the container of the present invention, the opening action can be done in a step-by-step manner, thanks to the cooperative effect of the planar surfaces 322 and the angled side 323 of the potuberance 321 of the movable seat 32 in conjunction with the elastic piece 34 of the locating seat 31. The precision electronic device 1 can be operated while it is kept in the container of the present invention. The cover piece 12 is prevented from swiveling back accidentally to join with the body piece 13 at the time when the electronic piece 1 is being operated.

The handle 22 can be located by degrees on the top of the shell 10 of the container of the present invention due to the joint effect of the pivot 221, the polygonal block 223, and the elastic piece 23. As a result, the handle 22 is prevented from impacting the top of the shell 10. In addition, the handle 22 is securely located on the top of the shell 10 such that the handle 22 does not sway when the handle 22 is not in use.

The downsized pull rod 40 minimize the space which is needed to accommodate the pull rod 40. The outer tube 421 and the inner tube 422 of the pull rod 40 are relatively small in diameter to reduce the weight and the material cost.

When the shell 10 of the present invention is moved by the wheel members 50 on a bumpy surface, the wheel arm 53 is actuated by the wheel 55 to swivel an angle, so as to enable the wheel 55 to displace inside the wheel chamber 513 to absorb the shock.

The structural strength of the shell 10 of the present invention is reinforced by the outer frame 122 and the inner frame 123.

The shell 10 is provided in the interior with the inner cushion 16 which is in turn provided with an elastic strip 162 and is disposed in the interior of the shell 10 such that the elastic strip 162 is retained in the groove 131 of the body piece 13.

The cover piece 12 and the body piece 13 of the shell 10 are provided with the frame slot 128 and the frame projection 129. The frame slot 128 is provided therein with the waterproof strip 17, which is pressed against by the frame projection 129 at the time when the cover piece 12 is swiveled to join with the body piece 13, thereby providing the shell 10 of the present invention with the waterproof effect.

The shock-absorbing pad 11 is removably disposed in the interior of the shell 10 to provide the electronic device 1 with protection against impact. The shock-absorbing pad 11 can be removed from the interior of the shell 10 to increase the space to accommodate more articles.

The present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A container comprising:

a shell comprised of a cover piece and a body piece;

a shock-absorbing pad disposed in the interior of said body piece and comprised of a space to accommodate a high precision electronic device;

a pivoting device comprising a locating seat and a movable seat, said locating seat provided with a cut, said movable seat provided with a protuberance which is pivoted in said cut of said locating seat by a pivot, said locating seat being fastened to said body piece of said shell, said movable seat being fastened to said cover piece of said shell; and a handle member comprised of a fixation seat and a handle pivoted to said fixation seat, said fixation seat being mounted on a top side of said shell and provided at two ends with an inverted U-shaped hole, said handle being comprised of a first pivot and a second pivot, with said first pivot being provided at an outer end with a polygonal block comprising a plurality of corners, said handle being pivoted in said U-shaped hole of said fixation seat by said first pivot and said second pivot, said fixation seat provided with an elastic piece which is in turn provided with an inverted triangular slot whereby said corners of said polygonal block of said handle are engaged one after another with said inverted triangular slot of said elastic piece, thereby enabling said handle to be turned by degrees on said two pivots.

2. The container as defined in claim 1, wherein said cover piece and said body piece of said shell are comprised of an outer frame and an inner frame, said outer frame being provided at one end with a receiving slot which is in turn provided therein with two hooks opposite in location to each other, said inner frame being provided at one end with a retaining projection or retaining slot whereby said inner frame is joined with said outer frame such that said retaining projection or retaining recess is caught by said hooks of said receiving slot of said outer frame.

3. The container as defined in claim 1, wherein said cover piece of said shell is comprised of a frame slot and a waterproof strip disposed in said frame slot; wherein said body piece of said shell is comprised of a frame projection whereby said frame projection presses against said waterproof strip at the time when said cover piece is joined with said body piece so as to close said shell.

4. The container as defined in claim 1, wherein said shock-absorbing pad is removably disposed in the interior of said body piece.

5. A container comprising:

a shell comprised of a body piece and a cover piece pivoted to said body piece;

a locking device fastened to said shell for locking said cover piece and said body piece;

a shock-absorbing pad disposed in the interior of said body piece of said shell and provided with a space to accommodate an electronic device;

a pivoting device comprising a locating seat fastened to said body piece of said shell, and a movable seat fastened to said cover piece of said shell, said locating seat being provided with a cut, said movable seat being provided with a protuberance whereby said protuberance is pivoted in said cut of said locating seat by a pivot;

a handle member comprised of a fixation seat mounted on a top side of said shell, and a hand grip fastened to said fixation seat; a pull rod fastened to said shell; and one or more wheel members mounted in a recess of a bottom said of said shell and comprised of a wheel seat, a wheel frame, a wheel arm, a rotary arm spring, and a wheel, said wheel seat being formed of a plate comprising a shell seat and a wheel chamber, said wheel frame being comprised of a face plate which is provided with two protective plates extending at a right angle in the same direction from said face plate, said protective plates provided with two stop pieces opposite to each other and extending at a right angle from said protective plates, said wheel arm being comprised of a cross plate and two support arms parallel to each other and extending at a right angle from said cross plate such that a top end of said two support arms juts out of said cross plate, and that a bottom end of said two support arms is extended slantingly downwards to facilitate the pivoting of said wheel, said top end of said two support arms and said cross plate being located between said two protective plates, said rotary arm spring comprising a center coil which is disposed between top ends of said two support arms in conjunction with a pivot, said rotary arm spring exerting a pressure on said face plate of said wheel frame, said center coil of said rotary arm spring exerting a pressure on a recess of said two support arms, said wheel arm being exerted on by a spring force of said rotary arm spring to lean toward a bottom of said face plate of said wheel frame, said wheel frame being inserted into said shell seat via said wheel chamber such that said face plate is fastened with said plate of said wheel seat, said wheel being oriented by said wheel arm to locate slightly out of said wheel chamber whereby said wheel arm is actuated by said wheel in motion to swivel, so as to enable said wheel to displace in said wheel chamber, said wheel arm being provided by said rotary arm spring with a recovery spring force enabling said wheel arm to return to an original position thereof after being actuated to swivel.

6. The container as defined in claim 5, wherein said cover piece and said body piece of said shell are comprised of an outer frame and an inner frame, said outer frame being provided at one end with a receiving slot which is provided therein with two hooks opposite in location to each other, said inner frame being provided at one end with a retaining projection or retaining slot whereby said inner frame is joined with said outer frame such that an said retaining projection or retaining recess is caught by said hooks of said receiving slot of said outer frame.

7. The container as defined in claim 5, wherein said cover piece of said shell is comprised of a frame slot and a waterproof strip disposed in said frame slot; wherein said body piece of said shell is comprised of a frame projection whereby said frame projection presses against said waterproof strip at the time when said cover piece is joined with said body piece to close said shell.

8. The container as defined in claim 5, wherein said shock-absorbing pad is removably disposed in the interior of said body piece of said shell.

9. A container comprising:

a shell comprised of a body piece and a cover piece pivoted with said body piece, said body piece and said cover piece being comprised of an outer frame and an inner frame, said outer frame provided at one end with a receiving slot which is provided therein with two hooks opposite in location to each other, said inner frame provided at one end with a retaining projection or retaining slot whereby said outer frame is joined with said inner frame such that said retaining projection or retaining slot of said inner frame is caught by said hooks of said receiving slot of said outer frame, said cover piece being comprised of a frame slot and a waterproof strip disposed in said frame slot, said body piece being comprised of a frame projection whereby said frame projection presses against said waterproof strip at the time when said cover piece is joined with said body piece to close said shell;

a shock-absorbing pad disposed in the interior of said body piece and comprised of a plurality of receiving slots and a space to dispose an electronic device;

a handle member comprised of a fixation seat and a handle fastened pivotally to said fixation seat which is fastened to a top side of said shell and is provided at two ends with a U-shaped hole, said handle provided with two pivots, one of said two pivots being provided at an outer end with a polygonal block comprising a plurality of corners, said handle being pivoted to said fixation seat by said two pivots which are received in said U-shaped holes, one of said two U-shaped holes being provided with an elastic piece having in the center thereof an inverted triangular slot engaging said corners of said polygonal block of said handle, thereby enabling said handle to be turned in a step-by-step manner;

a pivoting device comprising a locating seat and a movable seat, with said locating seat being provided at one end with a cut, and with said movable seat being provided with a protuberance whereby said protuberance is pivoted in said cut of said locating seat, said locating seat being fastened to said body piece of said shell, said movable seat being fastened to said cover piece of said shell, said locating seat being provided therein with an elastic piece fastened therewith such that an outer end of said elastic piece extends to reach the bottom wall of said cut, said protuberance of said movable seat comprising a polygonal cross section and a plurality of planar surfaces, and angled sides formed at the junctures of each of said planar surfaces, thereby enabling said movable seat to turn by degrees due to action of said planar surfaces, said angled sides and said elastic piece;

a downsized pull rod comprised of two expandable tubular members, and a hand grip fastened to said two tubular members, said tubular members being fastened to a bottom seat located in said shell, said tubular members being comprised of an outer tube and an inner tube slidably fitted into said outer tube, said inner tube being comprised of, in the outer wall of a bottom end thereof, an upper projected ring, a lower projected ring, and two holes for retaining a guide piece whereby said inner tube is fitted into said outer tube such that only said upper projected ring, said lower projected ring, and said guide piece come in contact with the inner wall of said outer tube, said outer tube being provided at an upper end port thereof with a stop ring for stopping said upper projected ring of said inner tube at such time when said inner tube is pulled out of said outer tube via said upper end port of said outer tube, thereby preventing separation of said inner tube from said outer tube; and one or more wheel members mounted in a bottom side of said shell and comprised of a wheel seat, a wheel frame, a wheel arm, a rotary arm spring, and a wheel, said wheel seat being provided with a plate comprising a hollow shell seat and a wheel chamber, said wheel frame comprised of a face plate and two protective plates extending at a right angle from said face plate such that said protective plates are parallel to each other and that said protective plates are provided at an outer end with a stop piece extending at a right angle therefrom, said wheel arm comprising a cross plate and two support arms extending at a right angle from said cross plate such that said two support arms are parallel to each other, and that a bottom end of said two support arms in slanted to facilitate the pivoting of said wheel, and further that a top end of said two support arms and said cross plate are located between said two protective plates, said rotary arm spring being provided with a center coil which is disposed between said top ends of said two support arms in conjunction with a pivot such that said rotary arm spring puts a pressure on said face plate, and that said center coil puts a pressure on a recess of said two support arms, said wheel arm being exerted on by a spring force of said rotary arm spring to lean toward said face plate of said wheel frame, said wheel frame being located in said shell seat via said wheel chamber such that said wheel is oriented by said wheel arm to move slightly out of said wheel chamber and that said wheel arm is actuated to swivel by said wheel in motion, thereby enabling said wheel to displace in said wheel chamber, said wheel arm being provided by said rotary arm spring with a recovery spring force enabling said wheel arm to return to an original position thereof after being actuated to swivel.

10. A container comprising:

a shell having a body piece and a cover piece pivoted to said body piece;

a locking means affixed to said shell, said locking means for fastening said body piece to said cover piece;

a shock-absorbing pad disposed in an interior of said shell, said shock-absorbing pad having a plurality of receiving slots formed therein and a space formed therein, said space having a size suitable for receiving an electronic device therein;

a handle member mounted to a top side of said shell, said handle member having a fixation seat and a handle fastened to said fixation seat;

a pull rod fastened to one side of said shell;

at least one wheel member fastened pivotally to a bottom side of said shell; and a pivoting means fastened to said shell for pivoting said cover piece with respect to said body piece, said pivoting means comprising a location seat and a movable seat, said locating seat having a cut, said movable seat having a protuberance which is pivoted in said cut of said locating seat by a pivot, said locating seat having an elastic piece with one end thereof being extended to reach a bottom wall of said cut, said movable seat further provided with a polygonal block having a plurality of planar surfaces and an angled side which is formed at a juncture of two of said planar surfaces whereby said planar surfaces and said angled sides and said elastic piece cooperatively work together to enable said cover piece to swivel on said pivoting means in a step-by-step manner.

11. The container as defined in claim 10, wherein said cover piece and said body piece of said shell are comprised of an outer frame and an inner frame, said outer frame being provided at one end with a receiving slot having two hooks opposite in location to each other, said inner frame being provided at one end with a retaining projection or a retaining slot whereby said inner frame is joined with said outer frame such that said retaining projection or said retaining slot is retained by said hooks of said receiving slot of said outer frame.

12. The container as defined in claim 10, wherein said cover piece of said shell is comprised of a frame slot and a waterproof strip disposed in said frame slot; wherein said body piece of said shell is comprised of a frame projection whereby said frame projection presses against said waterproof strip when said cover piece is joined with said body piece so as to close said shell.

13. The container as defined in claim 12, wherein said shock-absorbing pad is removably disposed in the interior of said shell.

* * * * *